US005915372A

United States Patent [19]

Wiedemann et al.

[11] Patent Number: 5,915,372

[45] Date of Patent: Jun. 29, 1999

[54] HEAT EXCHANGER

[75] Inventors: Peter Wiedemann, Klosterlechfeld; Franz Koch, Untermeitingen; Gerd Gumienny, Landsberg, all of Germany

[73] Assignee: Rational GmbH, Landsberg a. Lech, Germany

[21] Appl. No.: 09/015,120

[22] Filed: Jan. 29, 1998

[30] Foreign Application Priority Data

Jan. 30, 1997 [DE] Germany ..... 197 03 319
Feb. 28, 1997 [DE] Germany ..... 197 08 231

[51] Int. Cl.[6] ..... F24C 15/32

[52] U.S. Cl. ..... 126/21 A; 126/91 A

[58] Field of Search ..... 126/21 A, 91 A, 126/110 R

[56] References Cited

U.S. PATENT DOCUMENTS

| | | | |
|---|---|---|---|
| 3,605,717 | 9/1971 | Sauer | 126/21 A |
| 4,648,377 | 3/1987 | Van Camp | 126/21 A |
| 5,060,722 | 10/1991 | Zdenek et al. | 126/110 R |
| 5,165,889 | 11/1992 | Baggott | 126/91 A |
| 5,309,890 | 5/1994 | Rieke et al. | 126/110 R |
| 5,664,555 | 9/1997 | Maschhoff et al. | 126/91 A |

FOREIGN PATENT DOCUMENTS

| | | |
|---|---|---|
| 0 526 768 | 2/1993 | European Pat. Off. . |
| 1 841 213 | 11/1961 | Germany . |

*Primary Examiner*—Carroll B. Dority
*Attorney, Agent, or Firm*—Hill & Simpson

[57] ABSTRACT

A heat exchanger for a cooking chamber extends around a ventilator fan of the cooking chamber and has a burner tube connected to one end of a first portion of the heat exchanger and has a reverse bend so a second portion extends parallel to the first portion in the opposite direction. The tube is mounted by the burner and the opposite end so that the reverse bends allows for compensation of thermal expansion in the tube during a heating process.

17 Claims, 3 Drawing Sheets

HEAT EXCHANGER

BACKGROUND OF THE INVENTION

The present invention is directed to a heat exchanger having a ventilator wheel or fan, in particular a radial ventilator wheel or fan, a burner and at least one heat exchanger tube which is allocated to the burner and which tube surrounds a portion of the ventilator fan.

A heat exchanger having a heat exchange tube which surrounds a portion of a radial fan is disclosed in EP 0 526 768 B1. This device is used to cook foodstuffs in a cooking chamber of a corresponding cooking apparatus.

A problem with gas-heated heat exchangers is that stresses arise due to the high temperature, which stresses, on the one hand, must be absorbed or relieved in the tubes and, on the other hand, these stresses load the tube, in particular at the fastening points on the housing, frame or the like of the apparatus. At the same time, a high efficiency of the heat exchange is to be sought. For this purpose, EP 0 526 768 B1 proposes that the heat exchanger tube is routed in a spiral shape about the ventilator wheel, and this produces a more uniform heat expansion of the heat exchanger tube to occur, and, thus, simultaneously optimizes the heat transfer. However, there remains the problem that, in addition, the fastening points of the heat exchanger tube to the housing wall or the like are still placed under stress.

SUMMARY OF THE INVENTION

It is an object of the present invention to solve the problem of stress of a heat exchanger tube at the point of attachment to the housing wall.

For this purpose, the present invention provides a heat exchanger comprising a heat exchanger tube, which is bent to surround a ventilator wheel or radial fan and has two tube sections or portions interconnected by a bend portion. This bend portion is a bend with a U-shape or a return bend, which is spaced from the fastening points and free to move relative to the fastening points to help absorb the heat expansions so that the fastening points of the heat exchanger tube are largely relieved of stress. If desired, the heat exchange tube could have more than two sections interconnected by more than one return bend.

Preferably, the heat exchanger tube comprises an enlarged cross-section in the region of the return bend. Due to the changing of the direction of flow at the return bend, an increased resistance to the flow will result in the region of the return bend due to the formation of eddie currents, which are compensated according to the present invention by the expansion of the cross-section of the tube. Ideally, this expanded cross-section is dimensioned so that the flow resistance in the region of the bend is essentially the same as in the two tube segments that lead to or away from the bend. The danger of a local overheating is also avoided by this structure.

An enlarged cross-section in the region of the return bend can be reached, in particular, by causing the two tube segments that form the return bend to meet one another at an acute angle.

Advantageously, the heat exchanger tube has an oval cross-section in the region of the return bend.

Preferably, the freely-projecting return bend can be formed by a change of direction of 180° in the heat exchanger tube. For example, by means of a return bend, a horizontal or vertical end is produced that can, at first, be provided with a distance to other system components, which distance is sufficient for heat expansions to be absorbed or, respectively, compensated without problems.

It is also preferable for the return bend to be provided far from the fastening points of the heat exchanger tube on the housing wall or the like.

According to a preferred embodiment of the invention, the heat exchanger tube is routed around the ventilator wheel along an outline of a rectangular surface. The heat exchanger tube thereby surrounds the fan in the shape of a square or rectangle so that the tube bends lie in the respective comers of this rectangle or square. By this means, a particularly large surface is created for heat transfer. Moreover, this arrangement is advantageous given the standard cuboidal geometries of the spaces for heat treatment of foods, since, in this way, an optimal use of the space is achieved.

When the return bend is provided at the location of, or in the vicinity of the location of, a complete circling of the heat exchanger tube about the ventilator wheel, after the bend, the heat exchanger tube can be led back parallel to the original portions of the tube so that a compact and simple arrangement of the heat exchanger tube can be formed.

The invention makes it possible to do without cost-intensive corrugated tubes, and, in particular, to use heat exchanger tubes that have a smooth outer surface. Thus, a hygienic, advantageous cleaning is thereby possible. In addition, the tube can be of a sufficiently massive construction so that the danger of mechanical damage is relatively small and the life span and operational reliability or safety will be ensured.

Preferably, a heat exchanger means as described above is used in an apparatus for heat treatment of foods, wherein the heat exchanger means can be arranged in the cooking chamber of the apparatus without fear of adverse effects on the foodstuff to be cooked. The possibility of simple cleaning represents a particular advantage of the heat exchanger means for its intended use.

Other advantages and features of the invention will be readily apparent from the following description of the preferred embodiments, the drawings and claims.

DESCRIPTION OF THE PREFERRED EMBODIMENTS

Figure 1:
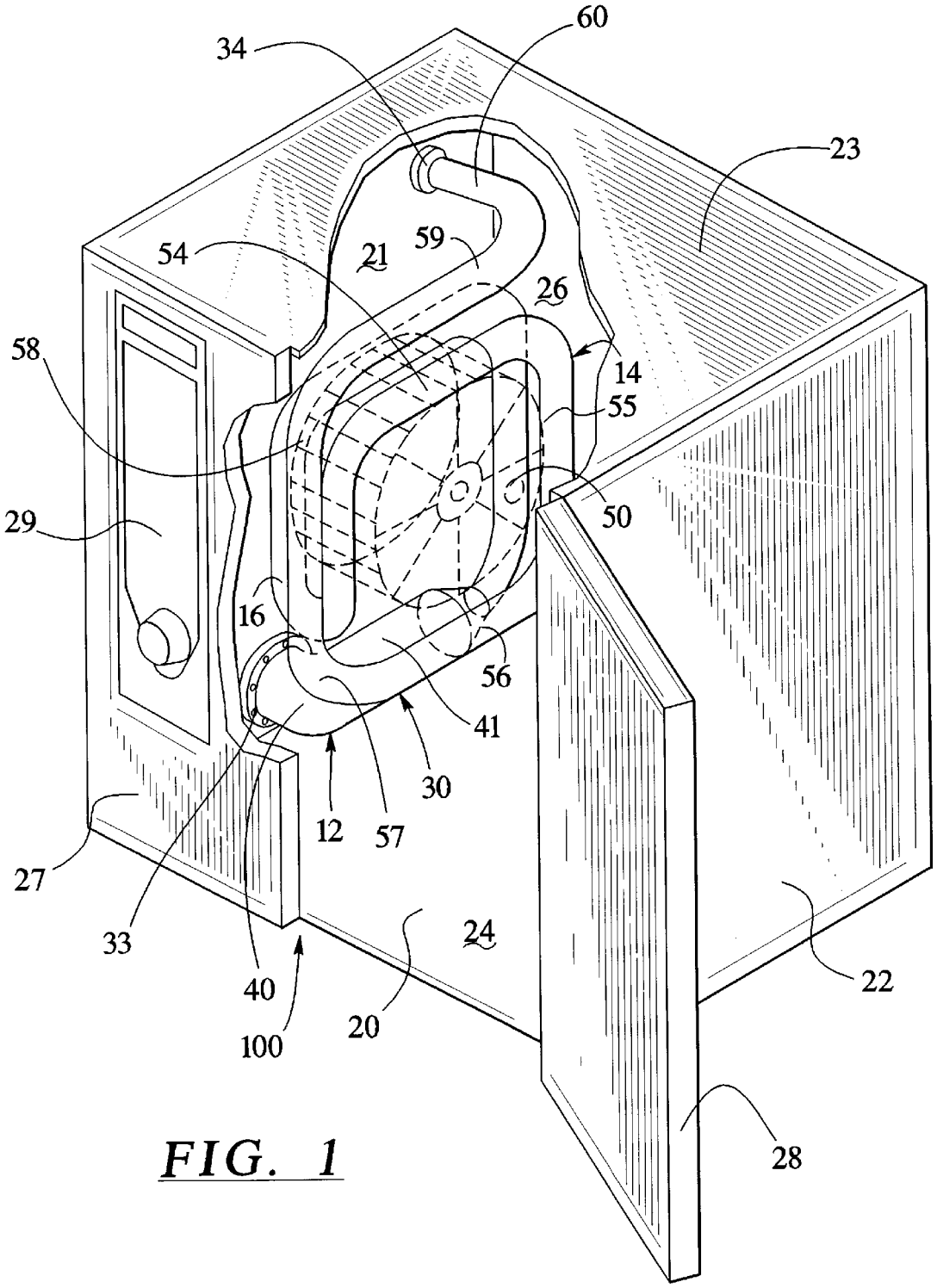
FIG. 1 is an isometric view of a cooking apparatus having a heat exchanger of the present invention mounted on a wall thereof.
Figure 2:
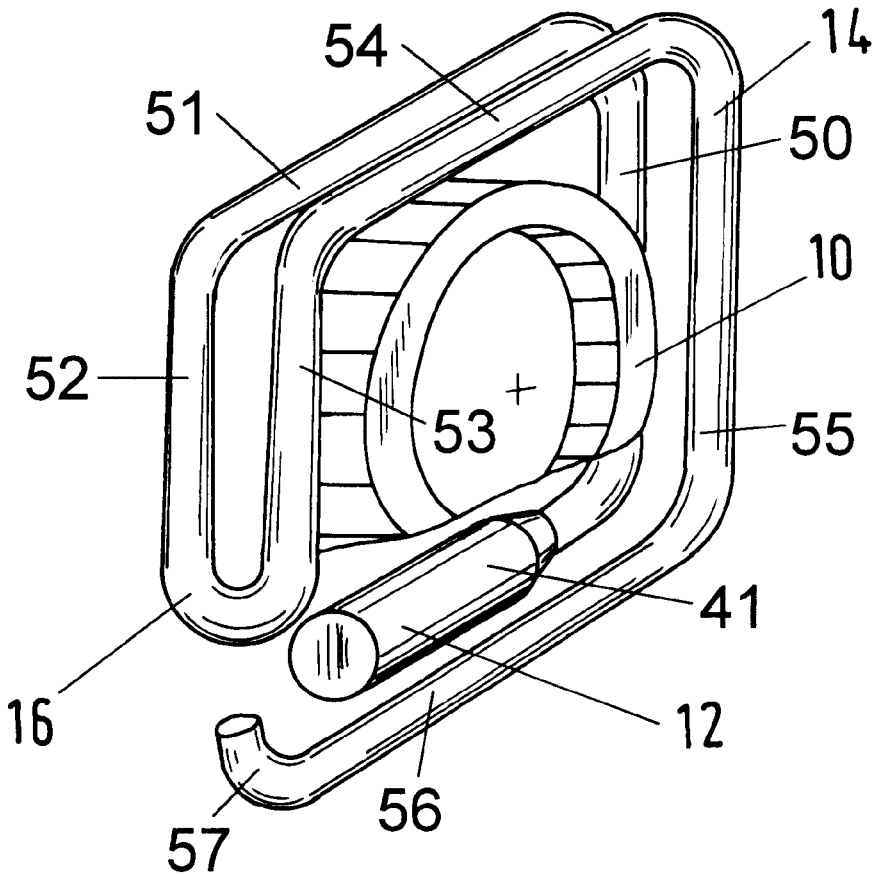
FIG. 2 is a schematic perspective view of a portion of the heat exchanger tube of FIG. 1 surrounding a radial fan with the connections of the tube to the wall of the apparatus removed for purposes of illustration.

The principles of the present invention are particularly useful when incorporated in a cooking apparatus, generally indicated at 100. The cooking apparatus 100 has a cooking chamber 20, which is formed by a pair of end walls 21 and 22 which extend between a top 23 and a bottom 24, a back 26 and a front side 27, which has a door 28. The front wall 27 also is provided with a control panel 29 having various buttons and/or knobs for controlling the operation of the apparatus 100. A heat exchanger, generally indicated at 30 in FIG. 1, comprises a heat exchange tube 14 having one end connected by a flange 34 on the end wall 21 and the other end extending into a burner chamber 12, which has a flange 33 mounting the end of the burner chamber on the end wall 21. As illustrated in FIG. 1, the tube 14 is bent into a substantially rectangular or square configuration, which surrounds a radial fan 10, which is illustrated in broken lines in FIG. 1 and is best illustrated in FIG. 2. As shown in FIG. 1, the burner 12 has a tube portion 40 adjacent the flange 33 which extends at right angles to the main tube portion 41 of the burner.

The heat exchanger tube 14 (see FIG. 2) has a vertical portion 50 connected by a right angle bend to the end of the main tube burner portion 41. The vertical portion 50 is connected by a second right angle bend to a horizontal portion 51, which is connected by another right angle bend to a second vertical portion 52 that terminates in a U-shaped bend, reverse bend or return bend 16, which connects it to another or third vertical portion 53. The portion 53 is connected by a right angle bend to a second horizontal portion 54, which is connected by a right angle bend to a fourth vertical portion 55. The portion 55 is connected by a right angle bend into a third horizontal portion 56, which is connected by a right angle bend 57 to a fifth vertical portion 58, which is only shown in FIG. 1. The fifth vertical portion 58 is connected by a right angle bend to a fourth horizontal portion 59, which is connected by a short fifth horizontal portion 60 to the flange 34. In the embodiment illustrated in FIG. 1, the heat exchanger tube and the burner 12 are connected only by the two flanges. Thus, any thermal expansion that occurs in these tubes is partially compensated by the reverse parallel-extending portions of the two tubes and by the reverse or return bend 16.

As best illustrated in FIG. 2, the portions 52 and 53 extend parallel to each other, the portions 51 and 54 extend parallel to each other, the portions 50 and 55 extend parallel to each other and the portion 56 extends parallel to the main burner portion 41. These portions, as best illustrated in FIG. 2, wrap around a radial ventilator wheel or fan 10, which is driven by a motor and the tube portions are routed in such a way that they are first routed essentially along a square outline coming from the burner chamber or tube 12 in which a burner is located or, respectively, on which the burner acts. The curvature of the tube is provided in the corner regions of the imaginary square according to the predetermination of the material. After the heat exchanger tube 14 has formed almost a complete circle about the fan, it is routed or directed back with a change of direction of 180°, whereby a freely-projecting reverse bend 16 is formed. Thus, the graphic representation shows the reverse bend hanging downward and comprises a spacing from other system components that is sufficient to receive the heat expansion without effecting the two points of connection at the flanges 33 and 34. The heat exchanger tube 14 is then routed back on the outline of the same square and ends in the portions 58, 59 and 60, which connect the one end by the flange 34 to the wall 21. As long as the fastening points are sufficiently removed from the return bend 16, these points are relieved of any stresses created by thermal expansion, which expansion, for the most part, is absorbed by the freely-moving bend portion 16 or by the end segment formed thereby.

Figure 4:
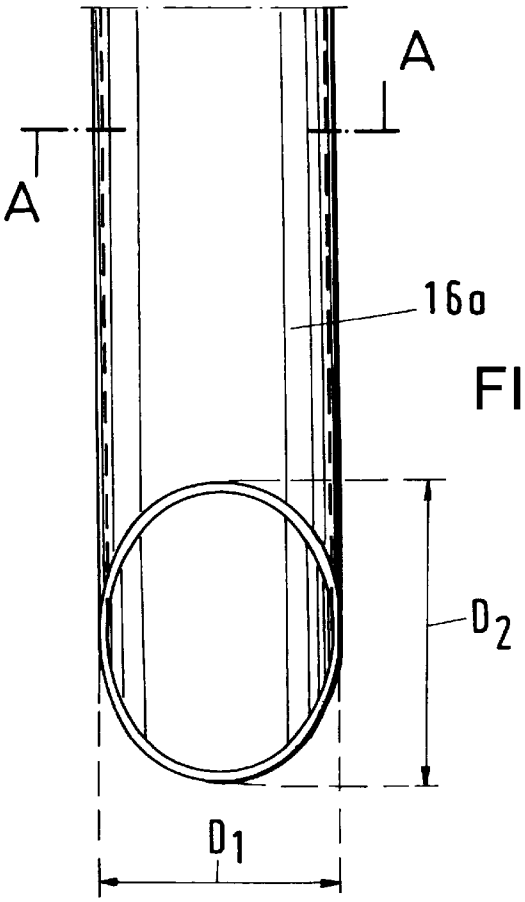
FIG. 4 is a cross-sectional view taken along the lines IV—IV of FIG. 3.
Figure 3:
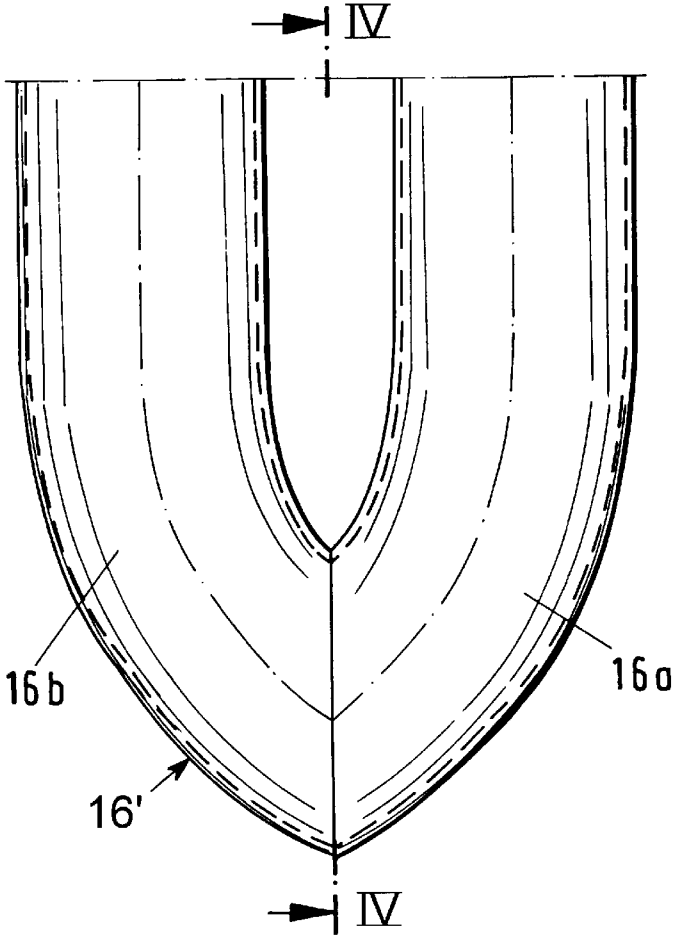
FIG. 3 is a side view of a return bend of a second embodiment of the invention.

In the embodiment illustrated in FIG. 3, which corresponds largely to the exemplary embodiment of FIG. 2, the two tube segments 16*a* and 16*b* meet at an acute angle in the region of the reverse bend 16'. Away from the reverse bend, i.e., at a height of the line A—A (see FIG. 4), the heat exchanger tube has an essentially circular cross-section with a diameter $D_1$. In the region of the reverse bend, by contrast, the tube has an essentially elliptical cross-section, whereby the minor axis of the ellipse has the size $D_1$ and the major axis of the ellipse has a size or diameter $D_2$, which is typically 1.2 to 1.4 times the diameter $D_1$. Preferably, it is approximately 1.3 times the size of $D_1$.

An enlargement of the cross-sectional surface of the tube is achieved in the region of the bend 16' , and an increase in the flow resistance in this region, which would otherwise occur due to the change of the direction in the region of the bend 16' and the formation of eddies associated therewith, is thereby counteracted. The cross-sectional surface of the heat exchanger tube 14 in the region of the bend 16' is typically 20% to 40% greater than the cross-section in the other regions of the tube 14. In the modification of the embodiment shown, an enlarged tubular cross-section can also be provided in the remaining right angle bend regions of the heat exchanger tube, in particular in the corner regions, with a deflection of essentially only 90°.

Although various minor modifications may be suggested by those versed in the art, it should be understood that we wish to embody within the scope of the patent granted hereon all such modifications as reasonably and properly come within the scope of our contribution to the art.

We claim:

1. A heat exchanger device having a ventilator fan, a burner and at least one heat exchanger tube being routed to surround the ventilator fan along an outline of a rectangular surface, said heat exchanger tube having two tube segments which meet at an acute angle to form a reverse bend having a change in direction of 180° and an enlarged oval cross-section, said heat exchanger tube being mounted on a wall of a chamber by fastening locations which are removed from the reverse bend.

2. A heat exchanger according to claim 1, wherein the reverse bend is provided at a location of the heat exchanger tube after the tube has completely circled the radial fan.

3. A heat exchanger according to claim 2, wherein the heat exchanger tube is a tube that is smooth on its outer surface.

4. An apparatus for processing food having a cooking chamber, a fan being mounted on one wall of the cooking chamber, a heat exchanger comprising a heat exchanger tube formed into a substantial rectangle around the fan having one end connected to a burner chamber which is connected to the one wall and the other end connected to the one wall, said tube having a reverse bend approximately midway along its length so that the tube extends in two parallel paths connected by the reverse bend.

5. An apparatus for processing food having a cooking chamber, a fan being mounted on one wall of the cooking chamber, a heat exchanger comprising a heat exchanger tube formed into a substantial rectangle around the fan having one end connected to a burner chamber which is connected to the one wall and the other end connected to the one wall, said tube having at least one bend portion between the ends of the tube so that the tube extends in at least two parallel paths connected by the bend portion.

6. A heat exchanger device for an apparatus for heat processing food, said apparatus having a ventilator van, a burner and at least one heat exchanger tube, said heat exchanger tube having a pair of side-by-side parallel extending segments substantially surrounding the ventilator fan and being interconnected by a reverse bend free to move to compensate for thermal expansion.

7. A heat exchanger device according to claim 6, wherein the heat exchanger tube comprises an enlarged cross-section in the region of the reverse bend.

8. A heat exchanger device according to claim 7, wherein the heat exchanger tube comprises an oval cross-section in the region of the reverse bend.

9. A heat exchanger device according to claim 7, wherein the reverse bend is formed by segments meeting at an acute angle.

10. A heat exchanger device according to claim 9, wherein the heat exchanger tube comprises an oval cross-section in the region of the reverse bend.

11. A heat exchanger device according to claim 10, wherein the heat exchanger tube is mounted on a wall of a chamber by fastening locations which are removed from the reverse bend.

12. A heat exchanger device according to claim 6, wherein one end of the heat exchanger tube is connected to the burner and the other end is connected to a wall of the apparatus so that exhaust products of the burner flow through the tube without contacting food in the apparatus.

13. A heat exchanger device according to claim 6, wherein the reverse bend creates a 180° change in the direction of the path of the heat exchanger tube.

14. A heat exchanger device according to claim 6, wherein the heat exchanger tube is mounted at its ends on a wall of a chamber and the reverse bend is substantially located midway between the ends so that the reverse bend is removed by a substantial amount of the tube from the point of fastening.

15. A heat exchanger device according to claim 6, wherein the heat exchanger tube is routed on an outline of a rectangle around the ventilator fan.

16. A heat exchanger device according to claim 1, wherein the reverse bend is located after the tube has formed almost a complete circle around the fan.

17. A heat exchanger device according to claim 6, wherein the heat exchanger tube has a smooth outer surface.

* * * * *